US011471347B2

(12) United States Patent
Kim

(10) Patent No.: US 11,471,347 B2
(45) Date of Patent: Oct. 18, 2022

(54) AUTOMATICALLY INFLATABLE PATIENT TRANSFER AIR MATTRESS

(71) Applicant: Dae Jong Kim, Cheongju-si (KR)

(72) Inventor: Dae Jong Kim, Cheongju-si (KR)

( * ) Notice: Subject to any disclaimer, the term of this patent is extended or adjusted under 35 U.S.C. 154(b) by 109 days.

(21) Appl. No.: 16/931,700

(22) Filed: Jul. 17, 2020

(65) Prior Publication Data

US 2021/0022937 A1 Jan. 28, 2021

(30) Foreign Application Priority Data

Jul. 22, 2019 (KR) ..... 10-2019-0088518
Jan. 22, 2020 (KR) ..... 10-2020-0008597

(51) Int. Cl.
*A61G 7/057* (2006.01)
*A47C 27/08* (2006.01)
*A61G 7/05* (2006.01)

(52) U.S. Cl.
CPC ..... *A61G 7/05769* (2013.01); *A47C 27/082* (2013.01); *A61G 7/0526* (2013.01)

(58) Field of Classification Search
CPC ..... A61G 7/05761; A61G 7/05769; A61G 3/0254; A61G 7/0526; A61G 10/005; A61G 7/1021; A61G 7/103; A61G 1/00; A61G 1/048; A61G 2200/327; A61G 2203/723; A61G 1/06; A61G 7/0504; A61F 5/34; A61F 5/37; A62C 27/00; A47C 27/082
See application file for complete search history.

(56) References Cited

U.S. PATENT DOCUMENTS 6,073,291 A 6/2000 Davis
7,774,877 B2 * 8/2010 Kenalty ..... A61G 1/01 5/81.1 R
2003/0106155 A1 * 6/2003 Arai ..... A61G 1/00 5/625
2012/0124752 A1 5/2012 Patrick
2019/0231083 A1 * 8/2019 Hsu ..... G16H 20/40

FOREIGN PATENT DOCUMENTS

KR 100938925 1/2010
WO 2005061060 7/2005

OTHER PUBLICATIONS

European Search Report—European Application No. 20186460.0 dated Nov. 20, 2020, citing US 2003/0106155, US 2012/0124752, WO 2005/061060, and U.S. Pat. No. 6,073,291.

* cited by examiner

*Primary Examiner* — David R Hare
*Assistant Examiner* — Madison Emanski
(74) *Attorney, Agent, or Firm* — Cantor Colburn LLP

(57) ABSTRACT

Provided is an automatically inflatable patient transfer air mattress designed to enable immobile persons, such as patients with mobility difficulty, to be rapidly laid and transferred thereon in the event of a disaster or an accident, prevent an injury to the patient caused by a falling object dropping from a ceiling or any other place, and reduce impact in the case of movement via stairs. The automatically inflatable patient transfer air mattress includes a main mattress portion forming a plate shape having a predetermined thickness when charged and inflated with air, a protective cover portion provided on one side surface of the main mattress portion in a longitudinal direction, and configured to cover one surface of the main mattress portion when deployed, and a cushion wheel unit disposed on a bottom (Continued)

portion of the main mattress portion to absorb impact from below.

8 Claims, 21 Drawing Sheets

AUTOMATICALLY INFLATABLE PATIENT TRANSFER AIR MATTRESS

TECHNICAL FIELD

The present disclosure relates to a patient transfer air mattress and, more particularly, to an automatically inflatable patient transfer air mattress designed to enable immobile persons, such as patients with mobility difficulty, to be rapidly laid and transferred thereon in the event of a disaster or an accident, prevent an injury to the patient caused by a falling object dropping from a ceiling or any other place, and reduce impact in the case of rapid movement via stairs or the like.

BACKGROUND ART

Referring to recent statistics data of the National Fire Information Center of the National Fire Agency of the Republic of Korea, the number of fires in medical facilities has gradually increased, from 67 fires in 2015 to 68 fires in 2016 and 73 fires in 2017.

In addition, in the event of a fire in medical facilities, a lot of casualties may occur, due to the characteristics of hospitals, namely, there are difficulties in how to evacuate vulnerable patients who cannot move their bodies by themselves and how to obtain the lines of movement of such.

In the occurrence of a fire, although each of the medical facilities is provided with an evacuation method, vulnerable patients may not be evacuated unless 2 to 4 persons are obtained for a single vulnerable patient. When manpower is insufficient and there are a number of vulnerable persons who cannot walk by themselves, such facilities may have a lot of casualties. Accordingly, a method of efficiently evacuating patients in the occurrence of a fire is required.

In addition, when vulnerable facilities have a fire, iron scraps or other fragments of walls may drop from upper structures, such as the ceiling. Thus, protective equipment able to protect patients who cannot move by themselves is required.

Furthermore, when a fire occurs inside a building, life may be threatened due to carbon monoxide poisoning or asphyxiation caused by smoke rather than flames. Smoke is generally characterized by extremely rapidly spreading in a short time and generally spreading to all directions along the ceiling. Thus, when a building has a fire, rapid evacuation within several minutes is required.

In the case of fire evacuation, it is extremely dangerous to use an elevator, since a hoistway through which the elevator moves serves as a chimney for fire and smoke and thus the possibility of asphyxiation in the elevator is high. Thus, it is necessary to evacuate via stairs.

Accordingly, when a building has a fire, there may be problems in evacuating immobile persons, such as wheelchair users, elder persons. Wheelchair users who cannot move via stairs or patients having difficulty in walking due to diseases or the like may fail to evacuate in time and thus be injured.

As an example of the related art, a life-saving stretcher for saving a drowning person is disclosed in Korean Patent No. 10-0938925 (Jan. 19, 2010).

The life-saving stretcher for saving a drowning person disclosed in this related art includes: a body inflating with air externally supplied thereto to be buoyant while being deployed into the shape of a mattress, the body having an air inlet through which the air is supplied and an air outlet through which the air supplied into the mattress is discharged, with a plurality of fiber yarns being provided in a vertical direction to respond to an internal pressure; an air supply supplying the air into the body; a receptacle provided integrally with the body to accommodate the air supply, and including a waterproof zipper able to open and close the inside of the receptacle and a traction cord provided on the front portion of the receptacle such that a lifesaver may hold and pull the traction cord; a connecting pipe having one portion connected to the air inlet of the body and the other portion screw-coupled with an inlet hole of the air supply such that the connecting pipe communicates with the air supply, the connecting pipe including an air shutoff valve disposed in a predetermined position; and fixing bands including Velcro tapes provided at rear ends of the body and allowing the body to remain fixed to the air supply without being untied from the air supply.

However, the background art described above has a problem in that, in the case of evacuation from a fire, the background art may fail to provide a shield against a falling object flying or dropping from above the life-saving stretcher, so that a patient may be subjected to a secondary accident. In addition, a plurality of persons is necessary to transfer a single patient via stairs. In this manner, there are a lot of problems to be solved to safely transfer a patient via stairs or the like. As described above, currently, a method able to safely transfer patients, such as severely injured patients, in the occurrence of a fire on a building is required.

DISCLOSURE

Technical Problem

The present disclosure is derived to meet the aforementioned demands of the related art, and an object of the present disclosure is to provide an automatically inflatable patient transfer air mattress able to prevent a patient having difficulty in movement from being injured by a flame, smoke, or a falling object flying from any place when transferring the patient in the event of a disaster or a fire.

Another object of the present disclosure is to provide an automatically inflatable patient transfer air mattress, the entirety of which may be automatically inflated to have an air capsule structure in response to air or gas being injected thereto in an emergency, such as a fire, thereby transferring a patient while protecting the patient.

Still another object of the present disclosure is to provide an automatically inflatable patient transfer air mattress able to efficiently block external impact that would be applied to the immobile person when transferring an immobile person, such as a patient, via stairs, on rough terrain, or the like.

Yet another object of the present disclosure is to provide an automatically inflatable patient transfer air mattress that has a light weight, is easily storable, and enables patient transfer to be easily performed by a minimal number of persons.

Technical Solution

In order to achieve the above objective, according to an aspect of the present disclosure, an automatically inflatable patient transfer air mattress may include: a main mattress portion forming a plate shape having a predetermined thickness when charged and inflated with air; a protective cover portion provided on one side surface of the main mattress portion in a longitudinal direction, and configured to cover one surface of the main mattress portion when deployed; and a cushion wheel unit disposed on a bottom portion of the main mattress portion to absorb impact from below.

In an embodiment, the cushion wheel unit may include: a cushion body fixedly attached to a bottom surface of the main mattress portion, in a shape of an embossment; a wheel-fixing portion disposed on an outer central portion of the cushion body, and a wheel rotatably coupled to the wheel-fixing portion.

In an embodiment, the automatically inflatable patient transfer air mattress may further include four side pad portions coupled to four edge portions of a top surface of the main mattress portion, respectively. The main mattress portion and the side pad portions may be coupled via first pad-joining portions. Second pad-joining portions may be located between and elastically coupled to adjacent side surfaces of the four side pad portions. One of the four side pad portions may be connected to the main mattress portion via a gas pipe channel in such a manner that fluid is in communication therebetween.

In an embodiment, the main mattress portion may include an air inlet or an air supply connected to a gas capsule storing compressed air or gas, such as inert gas, to supply air to an internal space of the main mattress portion.

In an embodiment, the gas capsule or a gas tank corresponding to the gas capsule may be disposed inside the main mattress portion. Of course, according to embodiments, the gas capsule or the gas tank corresponding to the gas capsule may be disposed outside the main mattress portion.

In an embodiment, the automatically inflatable patient transfer air mattress may include an oxygen tank in addition to or in place of the gas tank. In this case, an immobile person requiring the use of an oxygen respirator may be transferred using the air mattress.

In an embodiment, the protective cover portion or a cover corresponding to the protective cover portion may include: an air prefilter made of a nonwoven component; a charcoal filter provided below the air prefilter and serving as a carbon filtration filter composed by containing activated carbon; and a dustproof filter layer provided below the charcoal filter to block fine dust or particles of hazardous substances.

According to another aspect of the present disclosure, an automatically inflatable patient transfer air mattress may include a main mattress portion having a shape of a rectangular mattress charged and inflated with air; protective cover portions rolled up or folded on both sides of the main mattress portion in a longitudinal direction, and having a structure to cover the main mattress portion from above while being charged and inflated with air to have an arched dome shape; and one or more bottom protective mattresses connected to bottom portions of the main mattress portion, disposed at predetermined distances from each other, and able to absorb impact from below.

In an embodiment, the main mattress portion may include an air supply including a compressed gas capsule storing compressed air or gas. The air supply may automatically supply air by pulling a handle or an operation switch provided thereon.

In an embodiment, the main mattress portion, the protective cover portions, and the bottom protective mattresses are connected via connecting pipes to communicate with each other, and are configured such that the protective cover portions and the bottom protective mattresses are charged and inflated simultaneously when the main mattress portion is charged and inflated.

In an embodiment, the main mattress portion may include combined traction cords extending and protruding from one side thereof. The traction cords may be in the shape of shoulder straps passing over the shoulders such that a person may wear the traction cords on the shoulders to move the patient transfer air mattress or may be provided in the shape of straps having handles.

In an embodiment, each of the protective cover portions may include: an air prefilter made of a nonwoven component; a charcoal filter provided below the air prefilter and serving as a carbon filtration filter composed by containing activated carbon; and a dustproof filter layer provided below the charcoal filter to block fine dust or particles of hazardous substances.

In an embodiment, each of the bottom protective mattresses may further include an embossment on a bottom portion thereof in contact with the ground in order to minimize friction, the embossment having the shape of a convex hemisphere.

In an embodiment, the embossment may include a shock-absorbing ball spring disposed therein to absorb impact from below during transfer.

In an embodiment, each of the bottom protective mattresses may further include a ball spring on a bottom portion thereof in contact with the ground in order to minimize friction, the ball spring having the shape of a convex hemisphere.

Advantageous Effects

By using the automatically inflatable patient transfer air mattress as described above, it is possible to efficiently transfer a patient having difficulty in movement in the event of a disaster or a fire, prevent the patient from being injured by a falling object dropping to a transfer path from above during patient transportation, and protect the patient from a flame and smoke.

In addition, according to the present disclosure, the air mattress serves as a transfer tool having a soft mattress structure, and the entire air mattress is rapidly inflated with air or gas in an emergency to have a predetermined shape. The air mattress may efficiently absorb external impact even when movement via stairs. Thus, the air mattress enables an immobile person to be rapidly and safely evacuated by a small number of persons in a skyscraper, mountainous terrain, a ski resort, an airplane, a vessel, or the like.

In addition, according to the present disclosure, since the air mattress made of a fire retardant urethane material is used instead of a steel frame, the air mattress has light weight. In addition, since the air mattress may be stored in a rolled-up or folded state after use, the air mattress may be easily stored.

BEST MODE

Figure 1:
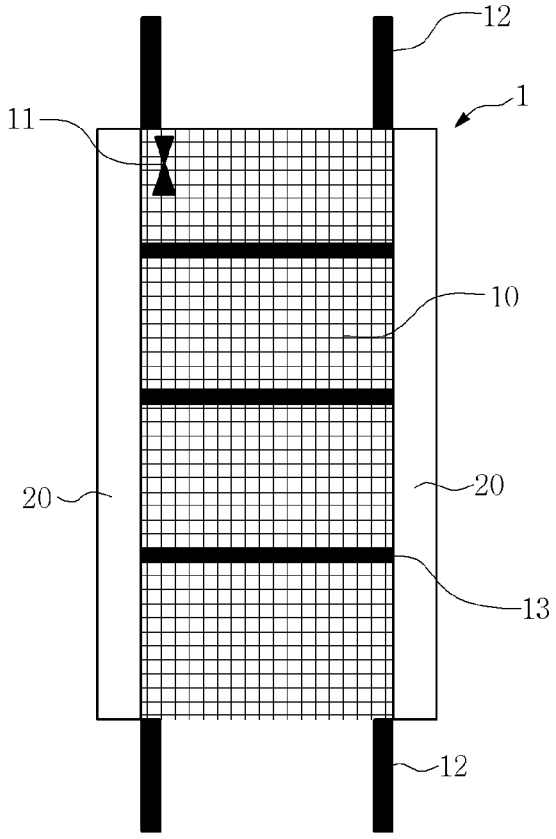
FIG. 1 is a plan view illustrating an automatically inflatable patient transfer air mattress (hereinafter, simply referred to as a "patient transfer air mattress") according to an embodiment of the present disclosure.

The advantages and features of the present disclosure and methods of the realization thereof will be apparent with reference to the accompanying drawings and detailed descriptions of the embodiments. The present disclosure should not be construed as being limited to the embodiments set forth herein and may be embodied in a variety of different forms. Rather, these embodiments are provided so that the present disclosure will be thorough and complete, and will fully convey the scope of the present disclosure to those skilled in the art. The scope of the present disclosure shall be construed on the basis of the accompanying claims. In describing the drawings, similar reference numerals are used for similar components.

Hereinafter, an automatically inflatable patient transfer air mattress according to embodiments of the present disclosure will be described with reference to the accompanying drawings.

Figure 2:
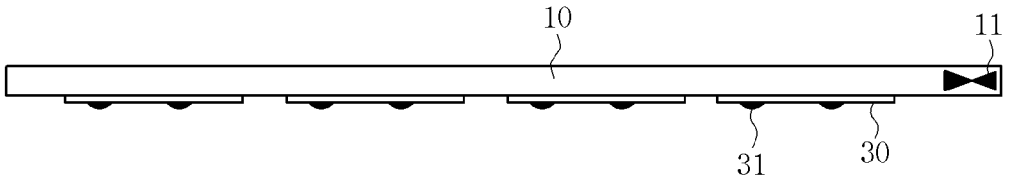
FIG. 2 is a side view of the patient transfer air mattress according to the embodiment of the present disclosure.
Figure 3:
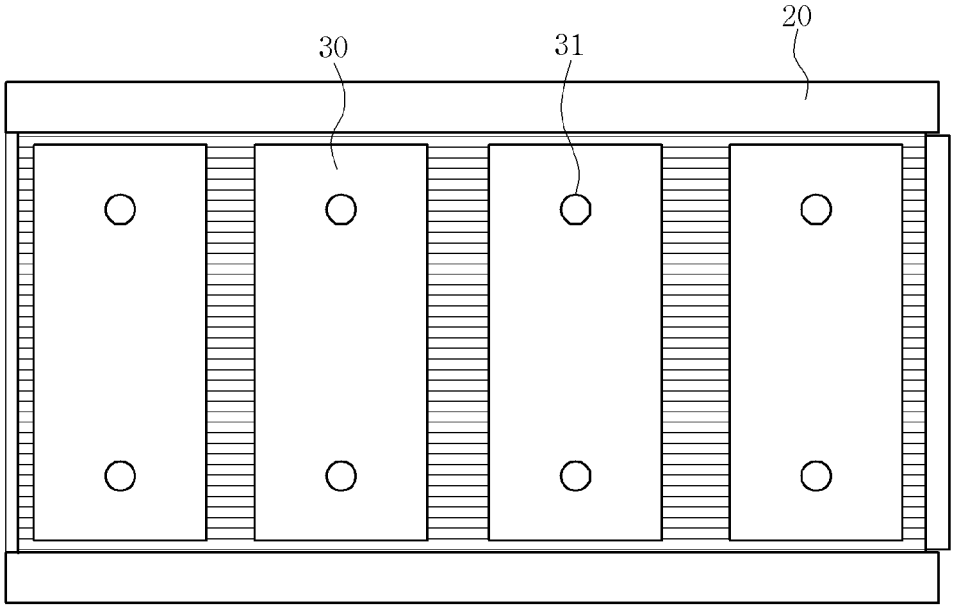
FIG. 3 is a bottom view of the patient transfer air mattress according to the embodiment of the present disclosure.
Figure 4:
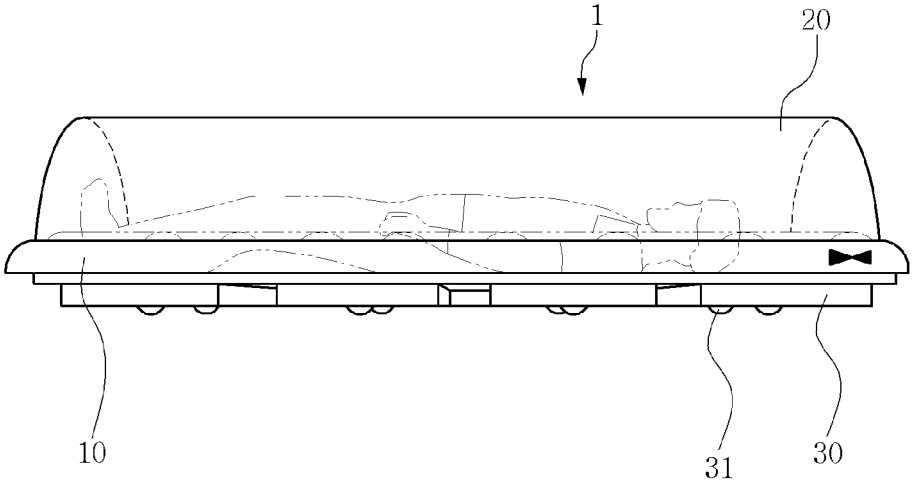
FIG. 4 is an example view illustrating a structure in which the patient transfer air mattress according to the embodiment of the present disclosure is charged to have the shape of an air capsule in an emergency.

FIG. 1 is a plan view illustrating an automatically inflatable patient transfer air mattress according to an embodiment of the present disclosure, FIG. 2 is a side view of the automatically inflatable patient transfer air mattress illustrated in FIG. 1, and FIG. 3 is a bottom view of the automatically inflatable patient transfer air mattress illustrated in FIG. 1. In addition, FIG. 4 is an example view illustrating a structure in which the automatically inflatable patient transfer air mattress according to the embodiment of the present disclosure is charged to have the shape of an air capsule in an emergency.

Hereinafter, the automatically inflatable patient transfer air mattress according to the embodiment of the present disclosure will be described with reference to FIGS. 1 to 4.

The automatically inflatable patient transfer air mattress 1 according to the present embodiment includes a main mattress portion 10 having the shape of a rectangular mattress able to maintain a predetermined height when charged with air (or gas), protective cover portions 20 inflatable to have a dome shape in an emergency in order to protect a patient during transfer from a falling object or a fire, and bottom protective mattresses 30 provided on the bottom portions of the main mattress portion 10 to absorb impact applied from below during transfer on the ground or stairs.

The main mattress portion 10 is a rectangular mattress designed to be inflated to a predetermined height in response to compressed air or compressed gas being rapidly supplied thereto.

The main mattress portion 10 includes an air inlet (not shown) through which an amount of air generated by an air supply 11 disposed in an internal portion of the main mattress portion 10 is supplied into the main mattress portion 10 and an air outlet (not shown) through which the supplied air is discharged. An opening and closing hole (not shown) able to open and close the air outlet is provided in the air outlet. The opening and closing hole may be implemented as a sealable zipper or a double Velcro-type opening and closing member. However, the opening and closing hole is not limited thereto, and substantially all types of sealable opening and closing means are applicable.

Thus, the main mattress portion 10 may include a handle or an operation switch (not shown) protruding from a predetermined position. The handle or the operation switch is connected to the air supply 11 such that the air supply 11 may be operated using the handle or the operation switch. Here, the handle may have a pulling structure by which the handle is pulled.

The air supply 11 supplying air or gas to the main mattress portion 10 may be any means able to store compressed air or gas and supply air or gas by a simple operation (e.g. an explosion or a chemical reaction).

For example, the principle of an inflatable airbag may be applied to the present disclosure. Sodium azide ($NaN_3$) composed of sodium (Na) and nitrogen ($N_2$) is an extremely safe material used to rapidly inflate an airbag. In a state in which $NaN_3$ is mixed with a compound known as iron oxide, pulling the connected switch or operation switch causes the mixture to react, thereby generating $N_2$ gas. Consequently, the generated $N_2$ gas may rapidly charge and inflate the main mattress portion 10.

In addition, the air supply 11 may be designed to include a sodium azide capsule, a small amount of iron oxide ($Fe_2O_3$), and a detonator inside the main mattress portion 10.

In another example, the air supply 11 may be designed to include a compressed air chamber or a gas capsule containing compressed carbon dioxide ($CO_2$), the compressed air room or the gas capsule being embedded in the main mattress portion 10. In this case, the gas capsule is unsealed by pulling the handle or the operation switch connected to the air supply 11. At this time, the inside of the main mattress portion 10 may be rapidly charged with air to a predetermined pressure.

In addition, in the main mattress portion 10, traction cords 12 and a plurality of fixing cords 13 may be combined. The traction cords 12 have predetermined lengths and are drawable in the case of patient transfer. The plurality of fixing cords 13 extends in a transverse direction of the main mattress portion and are spaced apart from each other by predetermined distances, such that the patient may be fixed using the plurality of fixing cords 13 in the case of transfer.

The traction cords 12 are cords made of a strong material, and are intended to allow only a single person to transport the patient on the automatically inflatable patient transfer air mattress according to the present disclosure. The traction cords 12 may be provided to extend and protrude upward and downward in the longitudinal direction of the main mattress portion 10.

The traction cords 12 may be provided in the shape of shoulder straps passing over the shoulders such that a person may wear the traction cords 12 on the shoulders to move the automatically inflatable patient transfer air mattress or may be provided in the shape of straps having handles.

The fixing cords 13 may be provided in the shape of belts, such as Velcro belts, ring-connected belts, or rope-tied belts in order to reliably fix the patient.

In addition, a headrest (not shown) may be further provided on one portion of the main mattress portion 10. The headrest may be connected to the main mattress portion 10 in such a manner that air is in communication therebetween in order to support the head of the patient or absorb impact applied to the head portion of the patient in the case of transfer.

The air supply 11 may be provided in the headrest portion. In addition, the headrest may be designed such that an emergency air supply may be additionally accommodated therein. Here, the emergency air supply may be a manual tank or the like in which gas, compressed air, or the like for quick internal charging in an emergency is stored.

The protective cover portions 20 may be protective covers located on both sides of the main mattress portion 10 in the longitudinal direction and serve as fall prevention rails to prevent the patient from falling off the sides in normal times. In an emergency, the protective cover portions 20 may be deployed and inflated to have the shape of an air capsule able to protect the patient during transfer from a falling object or a fire. The protective cover portions 20 may be provided together with a communication structure connected to the main mattress portion 10 via a connecting pipe.

Particularly, the protective cover portions 20 may be provided as a pair of protective cover portions on both sides of the main mattress portion 10 in the longitudinal direction so as to correspond to each other. The protective cover portions 20 provided on both sides of the main mattress portion 10, respectively, may communicate with the main mattress portion 10 and be charged and inflated with air (or gas) supplied thereto to have an arched dome shape, thereby covering the entire body of the patient. Thus, the protective cover portions 20 may realize a heat retaining function for maintaining the body temperature of the patient in an injury to the patient caused by a fire or during patient transfer, as well as a patient protection function for preventing the patient from being injured by a falling object.

When air is not supplied into the protective cover portions 20, the protective cover portions 20 may only serve as a blanket covering the patient to provide a protective cover function for patient protection and temperature retention.

In this regard, each of the protective cover portions 20 further includes an air inlet (not shown) through which air is supplied when the main mattress portion 10 is operated using the handle or the operation switch connected to the main mattress portion 10. In addition, each of the protective cover portions 20 may further include an air outlet (not shown) through which the air supplied into the protective cover portions 20 is discharged.

In addition, in the automatically inflatable patient transfer air mattress 1 according to the present embodiment, the bottom protective mattresses 30 may be disposed on the bottom portions of the main mattress portion 10 to absorb external impact during transfer via stairs or on rough terrain.

The bottom protective mattresses 30 may be a plurality of bottom protective mattresses disposed on the bottom portions of the main mattress portion 10 and spaced apart from each other by predetermined distances, thereby forming a shock-absorbing mattress serving as a cushion.

In addition, each of the bottom protective mattresses 30 may have an air inlet connected to the air inlet of the main mattress portion 10 such that air injected through the air inlet of the main mattress portion 10 is in communication therebetween. Each of the bottom protective mattresses 30 may be designed to be connected to and supplied with air from the air inlet of the main mattress portion 10 via a connecting pipe. In this case, when the main mattress portion 10 is operated and then supplied with air, the bottom protective mattresses 30 may be simultaneously supplied with the air, thereby being rapidly inflated and expanded.

Each of the bottom protective mattresses 30 may further include embossments 31 on bottom portions thereof in contact with the ground located therebelow in order to minimize friction with the bottom or the ground. The embossments 31 have the shape of convex hemispheres.

The embossments 31 may serve to minimize friction with the ground, thereby advantageously reducing impact applied from stairs or rough bottoms and facilitating patient transfer by a minimal number of persons.

Figure 5:
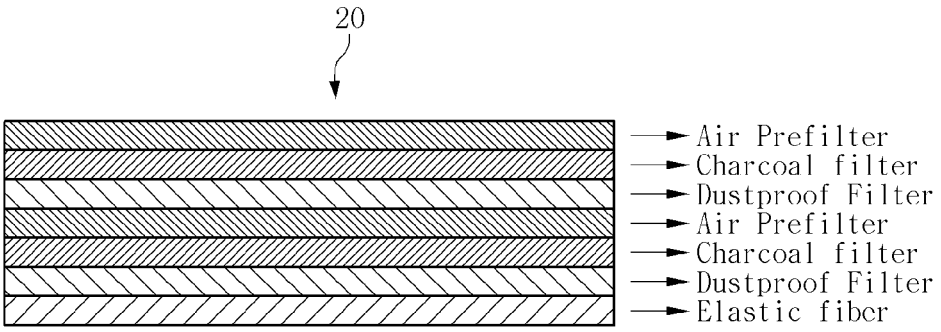
FIG. 5 is a configuration view illustrating a multilayer structure of each of the protective cover portions according to the embodiment of the present disclosure.

FIG. 5 is a configuration view illustrating a multilayer structure of each of the protective cover portions according to the embodiment of the present disclosure, illustrating all of an air prefilter, a charcoal filter, and a dustproof filter designed to have dual structures.

Referring to FIG. 5, in each of the protective cover portions 20, an air prefilter layer is provided in an outermost portion and is made of a nonwoven component. A charcoal filter, i.e. a carbon filtration filter composed by containing activated carbon, is provided below the air prefilter layer. A layer including a dustproof filter blocking particles of hazardous substances, such as fine dust, and having a dustproof and dust blocking function is provided below the charcoal filter. The dustproof filter has a dustproof index of, for example, KF94 or a higher index. In this manner, the protective cover portions 20 may provide a function of purifying external air, such as toxic gases caused by dust or a fire.

Since the entire structure of each of the protective cover portions 20 has a dual structure, the protective cover portions 20 may be realized to perform a stronger air purification function. In addition, the lowest layer of each of the protective cover portions 20 may be made of a high elastic fiber to reduce external impact applied to the bottom portion of the air mattress during patient transfer.

In addition, although each of the protective cover portions 20 is preferably provided in a shape in which the entire inside thereof may be charged with air, each of the protective cover portions 20 may be further designed to include a structure comprised of air frames (not shown) and connecting frames connecting the air frames). Here, only a portion of each of the air frames may be charged with air. The each of the protective cover portions 20 may include covers provided between the air frames and the connecting frames to block a falling object, in which none of the covers are supplied with air.

The air frames and the connecting frames may be provided as a plurality of pairs of frames extending in a transverse direction of the main mattress portion 10 and spaced apart from each other by predetermined distances. The frames may be provided in a rolled-up or folded state. The frames may be inflated and expanded with air supplied thereto to have an arch shape, thereby forming a dome structure protecting the patient using the cover portions.

In addition, the air frames and the connecting frames may be configured to communicate with the main mattress portion such that air may be supplied thereto. Each of the air frames and the connecting frames may include an opening and closing hole able to be opened to discharge the air supplied thereinto.

The air frames are inflated to have a dome shape similar to that of the protective cover portions 20, but the structure thereof may differ from that of the protective cover portions 20, in that air is only supplied into the air frames and the connecting frames to inflate the same, rather than being supplied to the entirety.

Figure 6A:
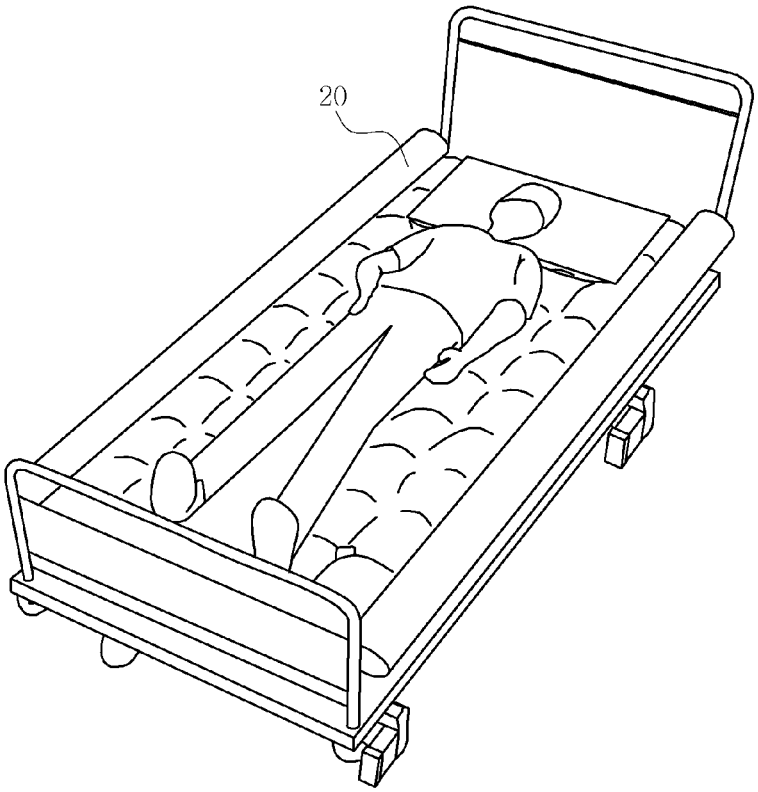
FIGS. 6A to 6C are example views illustrating a method of using the patient transfer air mattress according to the present disclosure.
Figure 6B:
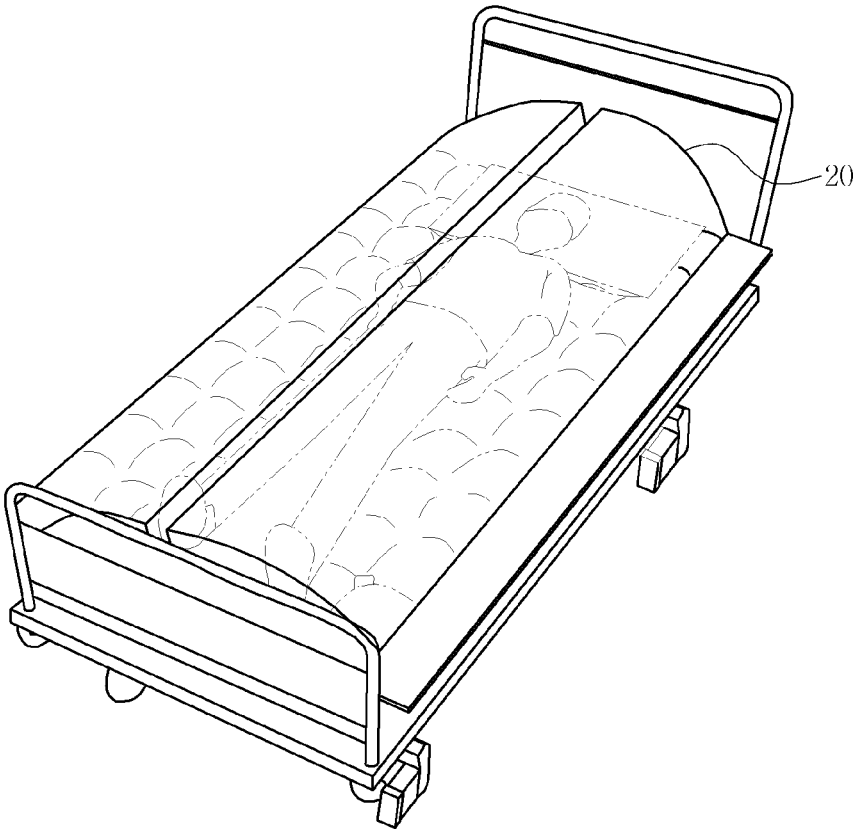
Figure 6C:
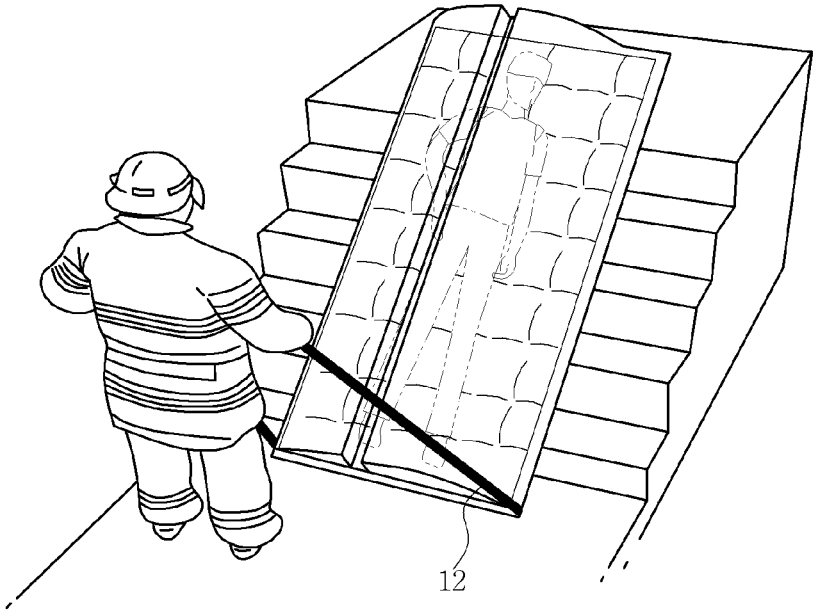

FIGS. 6A to 6C are example views illustrating a method of using the automatically inflatable patient transfer air mattress according to the present disclosure.

As illustrated in FIG. 6A, the automatically inflatable patient transfer air mattress according to the present disclosure may be provided on a bed of a patient or a person having difficulty in movement in normal times. Here, the protective cover portions according to the present disclosure may be used as means for preventing the patient from falling off the sides.

In addition, as illustrated in FIG. 6B, when the handle or the operation switch connected to the automatically inflating air supply is operated in the event of a disaster or an accident, such as a fire, the protective cover portions are inflated and deployed to have a dome shape and define an internal space, thereby forming an air capsule structure surrounding the patient. In this state, the patient may be transferred by pushing a stretcher cart on which the automatically inflatable patient transfer air mattress is placed.

In addition, the patient may be transferred only using an air pad without using a patient bed or a stretcher cart. That is, as illustrated in FIG. 6C, the patient on the air mattress may be transferred using the traction cords extending and protruding longitudinally from the main mattress portion. The traction cords may be provided in the shape of shoulder straps passing over the shoulders such that a person may wear the traction cords on the shoulders to move the automatically inflatable patient transfer air mattress or may be provided in the shape of straps having handles. FIG. 6C illustrates an example in which the patient is transferred using the straps having handles.

In addition, since the patient transfer air mattress according to a configuration of the present disclosure may reduce impact and friction from the bottom using the bottom protective mattresses and the embossments provided on the bottom portions of the bottom protective mattresses, only a single person or a minimal number of persons may easily transfer the patient while protecting the patient using the patient transfer air mattress even when transferring the patient via a place, such as stairs, as illustrated in FIG. 6C. In particular, in the case of patient transfer, the protective cover portions serving as a capsule having a dome shape may surround the entire body of the patient, thereby preventing the patient from being injured by a falling object, and perform an air purification function to remove hazardous smoke produced by a fire using an protective air gap formed in the protective cover portions in a combined manner, thereby providing maximum protection to the patient.

Figure 7:
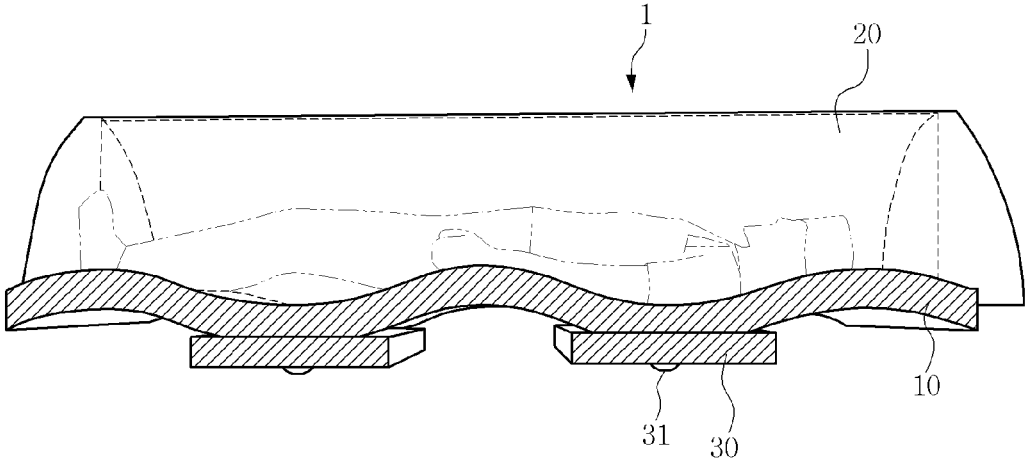
FIG. 7 is an example view illustrating a structure in which a patient transfer air mattress according to another embodiment of the present disclosure is charged to have the shape of an air capsule in an emergency.
Figure 8:
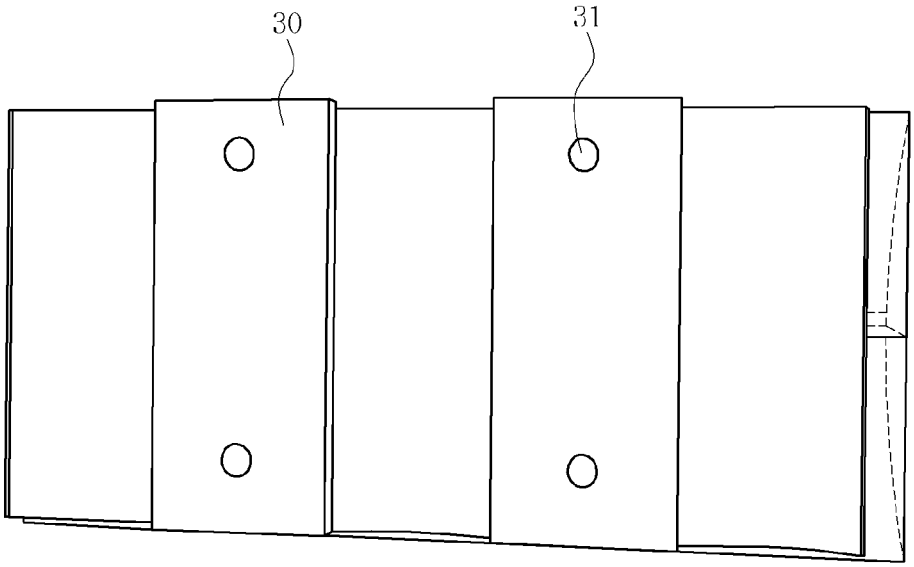
FIG. 8 is an example bottom view of the structure illustrated in FIG. 7.
Figure 9:
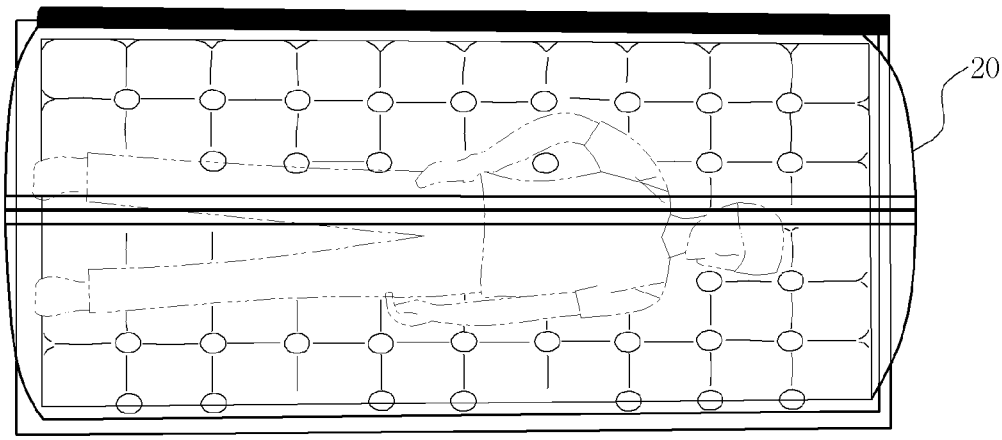
FIG. 9 is an example plan view of the structure illustrated in FIG. 7.

FIG. 7 is an example view illustrating a structure in which an automatically inflatable patient transfer air mattress according to another embodiment of the present disclosure is charged to have the shape of an air capsule in an emergency, FIG. 8 is an example bottom view of the structure illustrated in FIG. 7, and FIG. 9 is an example plan view of the structure illustrated in FIG. 7.

Referring to FIGS. 7 to 9, in the patient transfer air mattress according to the present embodiment, the main mattress portion 10 may be designed to be inflated while having bents. The main mattress portion 10 according to this design may more efficiently absorb impact occurring during the transfer of a patient and provide an effect of reducing the number of the bottom protective mattresses 30 connected thereto to be 2 or 3.

As described above, the automatically inflatable patient transfer air mattress according to the present disclosure is provided such that the entirety of the automatically inflatable patient transfer air mattress may be inflated to have the air capsule structure in a short time to absorb external impact when the immobile person is transferred via stairs or on rough terrain in the event of a disaster or a fire, thereby enabling the immobile person to be rapidly evacuated to a safe area. Not only on mountainous terrain but also on a volume of water, such as a river or a sea, the patient may be easily evacuated due to the buoyancy function using air. The patient may be easily transferred by only a single person or a minimal number of persons.

Figure 10:
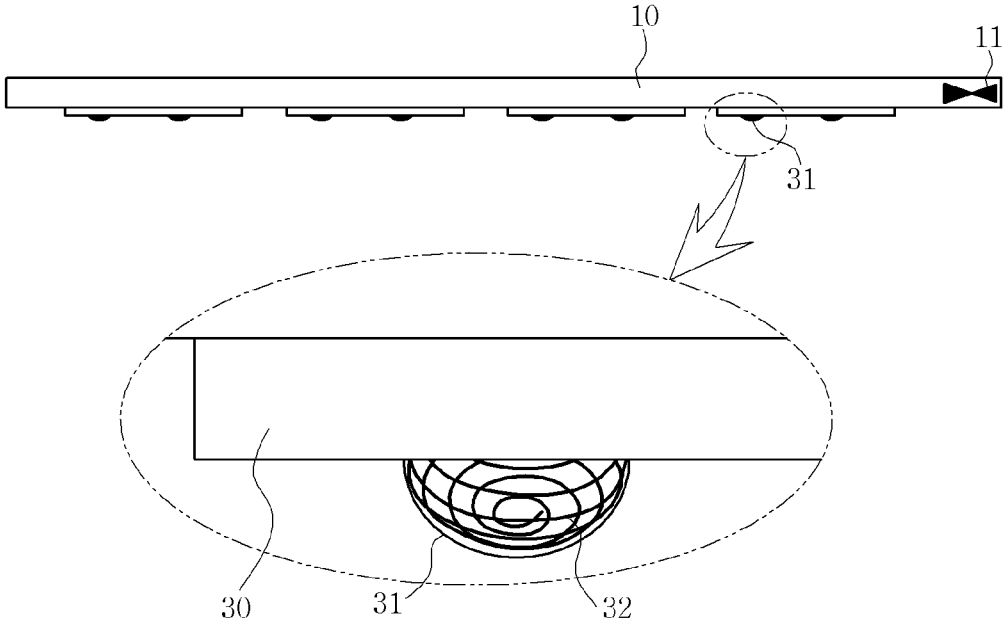
FIG. 10 is a view illustrating ball springs usable in a patient transfer air mattress according to yet another embodiment of the present disclosure.

FIG. 10 is a view illustrating ball springs usable in an automatically inflatable patient transfer air mattress according to yet another embodiment of the present disclosure.

Referring to FIG. 10, the automatically inflatable patient transfer air mattress according to the present embodiment may include ball springs substituting the embossments in the foregoing embodiment.

In each of the ball springs, a portion thereof may be inserted into the corresponding bottom protective mattress 30, and at least one end of the inserted portion may be fixed to the bottom protective mattress 30. The ball springs may be fabricated by winding linear elastic members to have the shape of a ball or a coil.

Meanwhile, the ball springs described above are not limited to substituting the embossments, but may be combined with the embossments. For example, the ball springs may be disposed inside the embossments 31, respectively, to perform a shock-absorbing function. In this case, the ball springs may be coil-shaped springs 32 wrapped on the embossments 31 to minimize the friction of the embossments, and may have a structure absorbing impact from the bottom using the ball springs during transfer.

On the other hand, although the foregoing embodiment has been described that the air inflated capsule structure is used, the present disclosure is not limited to such a configuration. The capsule structure may be realized using a different type of compressed gas or a gas generated by a chemical reaction of a chemical and air disposed therein.

Figure 11:
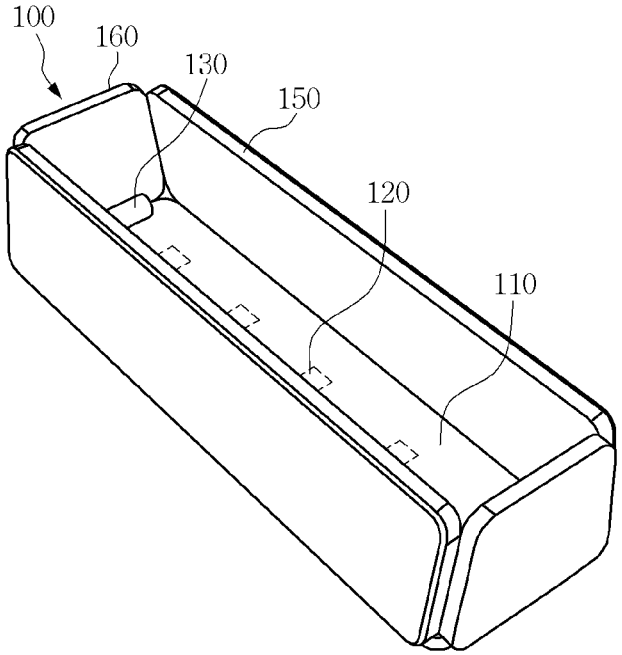
FIG. 11 is a perspective view illustrating a patient transfer air mattress according to still another embodiment of the present disclosure.
Figure 12:
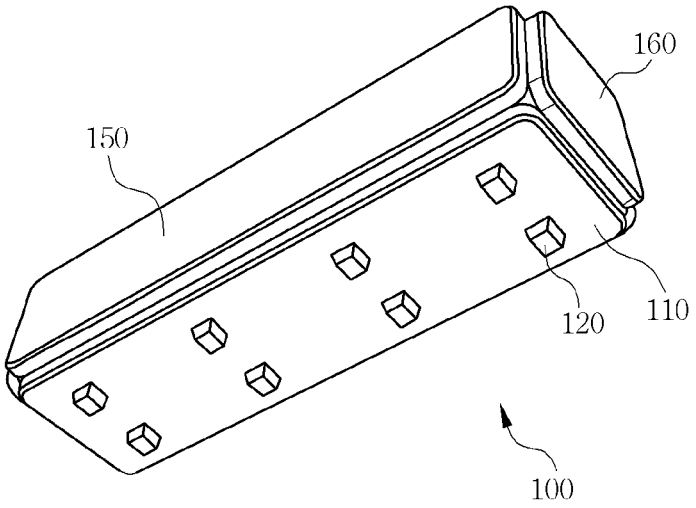
FIG. 12 is a bottom perspective view of the automatically inflatable patient transfer air mattress illustrated in FIG. 11.

FIG. 11 is a perspective view illustrating an automatically inflatable patient transfer air mattress according to still another embodiment of the present disclosure, and FIG. 12 is a bottom perspective view of the automatically inflatable patient transfer air mattress illustrated in FIG. 11.

Referring to FIGS. 11 and 12, the air mattress 100 according to the present embodiment includes a bottom pad 110, shock-absorbing members 120, an inflation regulator 130, first side pads 150, and second side pads 160.

The bottom pad 110 may have a certain level of strength of its own, and may be charged with a type of gas in response to the operation of the inflation regulator 130 so that the strength of the bottom pad 110 as a flat mattress is increased.

The shock-absorbing members 120 may be disposed on the bottom portion of the bottom pad 110 and be charged and inflated with gas. When the air mattress 100 is in contact with the ground or a bottom surface, the shock-absorbing members 120 serve to reduce the contact area and resistance between the air mattress 100 and the ground or the bottom surface, whereby the air mattress 100 or a person, such as a patient, laid on the air mattress 100 may be pulled and transferred with a small amount of force.

The inflation regulator 130 may include a tank in which compressed gas is stored and an opening and closing means, such as a valve, for regulating the open ratio of a pipe through which the gas is introduced to and discharged from the tank.

The first side pads 150 and the second side pads 160 remain attached to side surfaces of the bottom pad 110 while having flattened shapes or minimum volumes. When the gas is supplied in response to the operation of the valve or the like of the inflation regulator 130, the insides of the first side pads 150 and the second side pads 160 may be charged with the gas and the volumes of the first side pads 150 and the second side pads 160 may be increased so that the first side pads 150 and the second side pads 160 may be erected to predetermined heights on side surfaces of the bottom pad 110. Here, the vertical surfaces forming the boundaries between the first side pads 150 and the second side pads 160 may be integrally formed to maintain the joined state before and after gas charging.

In this regard, each of the second side pads 160 may have the shape of a plate having a predetermined thickness, in which, in the inflated position, the cross-sectional area of the top end portion thereof spaced apart from the bottom pad 110 by a predetermined height is smaller than the cross-sectional area of a portion thereof integrally connected to the bottom pad 110.

Meanwhile, each of the first side pads 150 may have the shape of a rectangular plate having a predetermined thickness, in which the cross-sectional area of the top end portion thereof spaced apart from the bottom pad 110 by a predetermined height is substantially the same as the cross-sectional area of a portion thereof integrally connected to the bottom pad 110.

In the above-described case, the first side pads 150 may be disposed such that, when the first side pads 150 and the second side pads 160 are charged and inflated with the gas, the first side pads 150 are slightly inclined from the side surfaces of the bottom pad 110 toward a position above the bottom pad 110 depending on the shape of the second side pads 160.

In addition, a cover may be integrally connected to the first side pads 150. The cover may be disposed to connect the pair of first side pads 150 facing each other and cover an open area defined by the upper portions of the first side pads 150 and second side pads 160, in response to the operation of a zipper.

The cover may correspond to the protective cover portions 20 illustrated in FIG. 4. The cover also may serve as a fire blanket. In addition, the shock-absorbing members 120, the bottom mattress 110, and the inflation regulator 130 may correspond to the bottom protective mattresses 30 or the embossments 31, the main mattress portion 10, and the air supply 11 according to the foregoing embodiments described with reference to FIGS. 1 to 10, respectively.

The air mattress 100 according to the present embodiment may be fabricated to have a length of 175 mm to 200 mm, a width of 500 mm to 700 mm, and a height of 300 mm to 500 mm when inflated. Each of the bottom pad 110 and the first and second side pads 150 and 160 may be fabricated to have a thickness of 10 mm to 100 mm when inflated.

Figure 13:
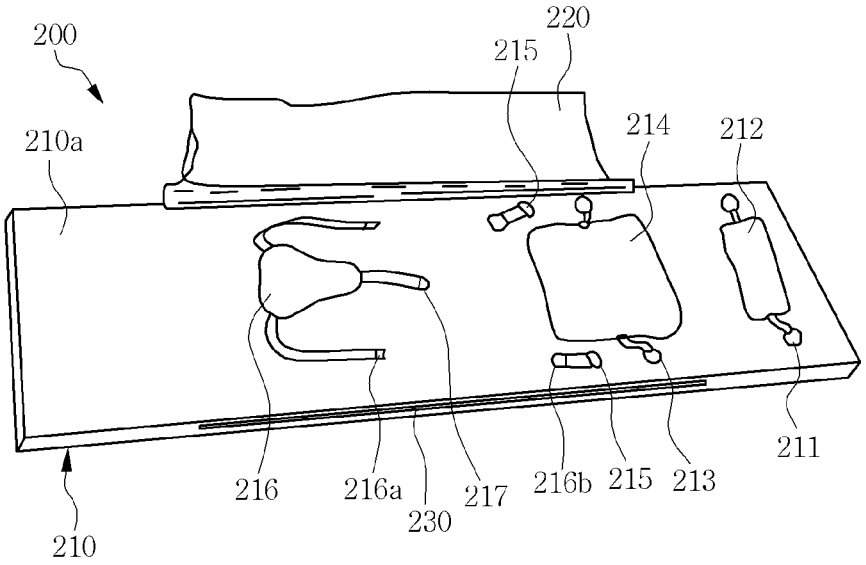
FIG. 13 is a perspective view illustrating a patient transfer air mattress according to still yet another embodiment of the present disclosure.
Figure 14:
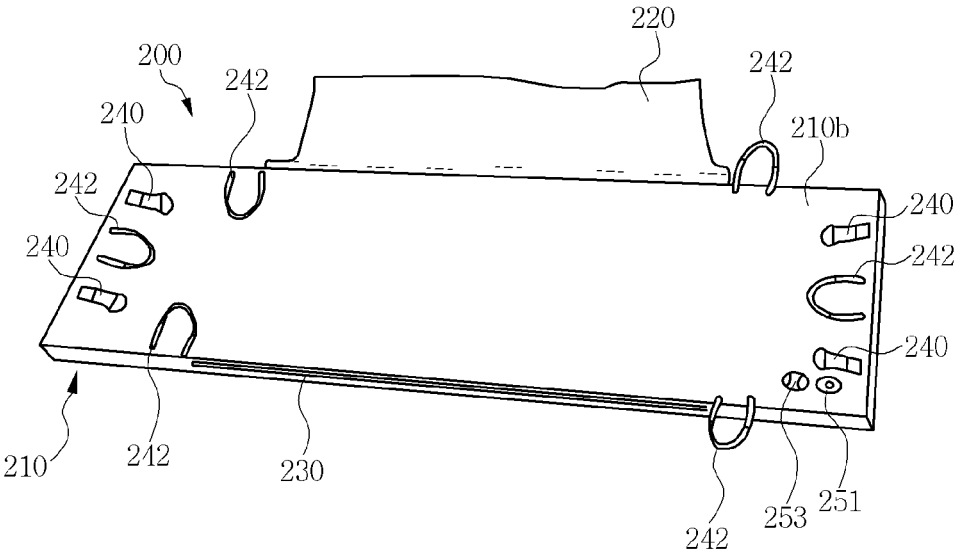
FIG. 14 is a bottom perspective view of the patient transfer air mattress illustrated in FIG. 13.
Figure 15:
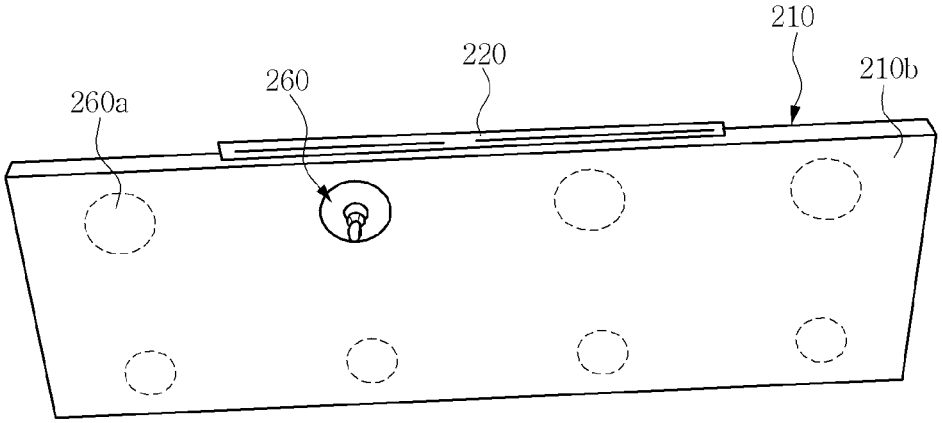
FIG. 15 is a schematic view illustrating embossment wheel units disposed on the bottom surface of the patient transfer air mattress illustrated in FIG. 14.
Figure 16:
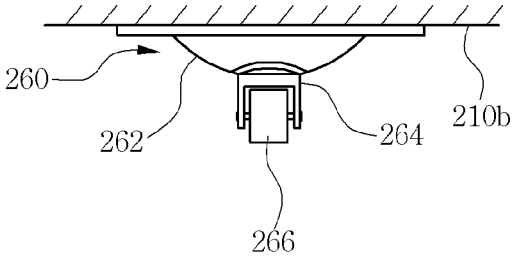
FIG. 16 is a partial plan view illustrating a structure usable in the embossment wheel units in FIG. 15.
Figure 17:
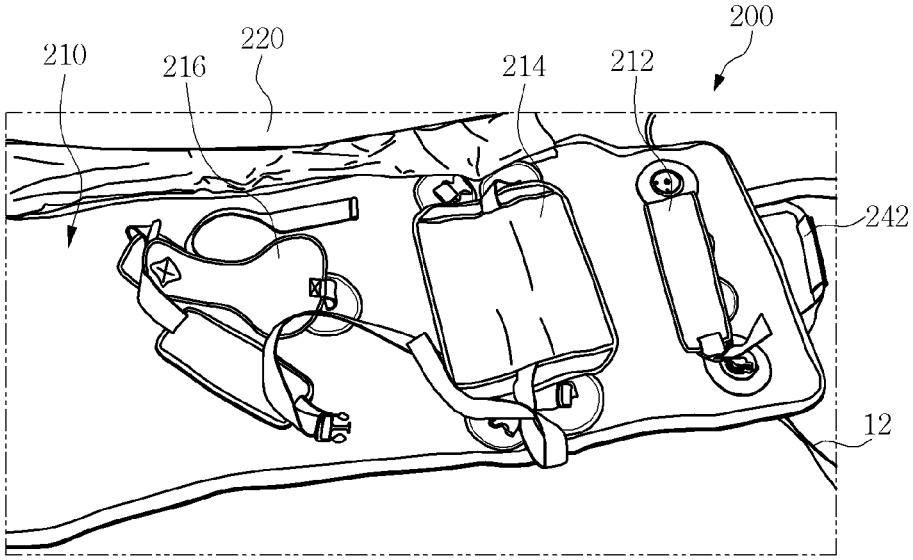
FIG. 17 is an example view illustrating a state in which inflation gas is discharged from the inside of the patient transfer air mattress illustrated in FIG. 13.

FIG. 13 is a perspective view illustrating an automatically inflatable patient transfer air mattress (hereinafter, simply referred to as a "patient transfer air mattress") according to still yet another embodiment of the present disclosure. FIG. 14 is a bottom perspective view of the patient transfer air mattress illustrated in FIG. 13. FIG. 15 is a schematic view illustrating embossment wheel units disposed on the bottom surface of the patient transfer air mattress illustrated in FIG. 14. FIG. 16 is a partial plan view illustrating a structure usable in the embossment wheel units in FIG. 15. In addition, FIG. 17 is an example view illustrating a state in which inflation gas is discharged from the inside of the patient transfer air mattress illustrated in FIG. 13.

Referring to FIGS. 13 and 14, the patient transfer air mattress 200 according to the present embodiment includes a main mattress portion 210, a cover 220, and cushion wheel units 260. The main mattress portion 210 may include a head-fixing unit 212, a body-fixing unit 214, a pelvis-fixing unit 216, a first joining means 230, a fastening means 240, handle straps 242, an air inlet 251, and an air outlet 253. A second joining means (see reference numeral 222 in FIG. 22) may be provided on one edge of the cover 220.

The main mattress portion 210 may be made of a flexible material, and may be formed to have the shape of a thin plate with a predetermined length and a predetermined width when the inside thereof is charged with gas or air. The main mattress portion 210 includes a first main surface or a top surface 210*a* and a second main surface or a bottom surface 210*b*.

The head-fixing unit 212 fixing the head of an immobile person, such as a patient, when the immobile person is laid, the body-fixing unit 214 fixing the body of the immobile person, and the pelvis-fixing unit 216 fixing the pelvis of the immobile person are disposed on the top surface 210*a*.

The head-fixing unit 212 is disposed on one end portion of the top surface 210*a* in the longitudinal direction, and the body-fixing unit 214 and the pelvis-fixing unit 216 are disposed in the described order toward the other end portion. One end of the pelvis-fixing unit 216 may be fixed to a substantially middle end portion of the top surface 210*a*.

The head-fixing unit 212 may include a sheet-shaped first body made of a flexible material and first fastening portions 211 fixedly coupling both ends of the first body to the top surface 210*a* of the main mattress portion 210. The body-fixing unit 214 may include a sheet-shaped second body made of a flexible material and second fastening portions 213 fixedly coupling both ends of the second body to the top surface 210*a* of the main mattress portion 210. In addition, the pelvis-fixing unit 216 may include a sheet-shaped third body made of a flexible material and third fastening portions 215 fixedly coupling three portions of the third body to the top surface 210*a* of the main mattress portion 210. Among three connecting members between the third body and the third fastening portions 215, two connecting members may be connected to each other via attachments. Each of the attachments may include a pair of female and male plastic buckles 216*a* and 216*b*.

The first joining means 230 is provided on one side surface of the main mattress portion 210. The first joining means 230 may be detachably coupled to the second joining means provided on one side of the cover 220. The first joining means 230 and the second joining means may be implemented as Velcro fasteners or the like.

The fastening means 240, the handle straps 242, the air inlet 251, and the air outlet 253 are provided on bottom surface 210*b*. The cushion wheel units 260 are also provided on the bottom surface 210*b*.

The fastening means 240 is fixedly disposed on the bottom surface 210*b* such that two portions thereof are provided on each end portion of the bottom surface 210*b* in the longitudinal direction. The fastening means 240 may include plastic buckles, one end of each of which is fixed to the bottom surface 210*b*. The plastic buckles of the fastening means 240 may be coupled to other plastic buckles, respectively, each of which forms a pairs together with the corresponding plastic buckle of the fastening means 240. In this manner, the fastening means 240 may be connected to the traction cords (see reference numeral 12 in FIG. 1).

The handle straps 242 may be disposed on four sides of the bottom surface 210*b*, respectively. The edge of each of the sides of the bottom surface 210*b* extending in the longitudinal direction may be provided with two handle straps 242. Each of the handle straps 242 may have the shape of a half ring, with both ends thereof being fixed to the bottom surface 210*b*, and be disposed pivotable in the range from above the bottom surface 210*b* to outside of the bottom surface 210*b*.

The air inlet 251 may be disposed on any position of the bottom surface 210*b*, for example, a corner portion. The air inlet 251 may include an insertion-fixing inlet or a screw-coupling inlet and be connected to a gas tank or a gas capsule via a connector to which a check valve is coupled. The gas tank or the gas capsule may be accommodated in the main mattress portion 210, and may be independently provided outside the main mattress portion 210 according to embodiments. The gas tank may also be referred to as an air tank, an inert gas tank, or the like.

Meanwhile, in addition to or in place of the gas tank described above, an oxygen tank may be provided. In this case, the immobile person who needs an oxygen respirator may be transferred using the air mattress.

The air outlet 253 has an openable structure to discharge gas or air charged in the internal space of the main mattress portion 210. The air outlet 253 has an opening and closing structure having durability and reliability able to withstand the internal pressure of the main mattress portion 210 charged with gas. The air outlet 253 may be disposed adjacent to the air inlet 251, but is not limited thereto.

As illustrated in FIG. 15, the cushion wheel units 260 are disposed on the bottom surface 210*b* of the main mattress portion 210. The plurality of cushion wheel units 260 may be disposed substantially evenly in predetermined positions 260*a* of the bottom surface 210*b*.

As illustrated in FIG. 16, each of the cushion wheel units 260 may include a cushion body 262 fixedly attached to the bottom surface 210*b*, a wheel-fixing portion 264 coupled to the central portion of the cushion body 262, and a wheel 266 rotatably coupled to the wheel-fixing portion 264.

The cushion body 262 is disposed on the bottom surface 210*b*, in the shape of a convex or an embossment made of an elastic material. The cushion body 262 may be made of a rubber material or the like. In addition, a spring or another elastic member may be additionally inserted into the cushion body 262.

The wheel-fixing portion 264 may freely rotate on the cushion body 262 and support the wheel 266, with one end thereof being coupled to the most protruding portion, i.e. the central portion of the embossment, of the cushion body 262, and the other end thereof being coupled to the wheel 266.

In the patient transfer air mattress 200 according to the present embodiment described above, flexible components may freely overlap each other in a state in which the gas is discharged from the inside of the patient transfer air mattress 200, as illustrated in FIG. 17. In a state in which the components are placed on the top surface 210*a* of the main mattress portion 210, the main mattress portion 210 may be rolled up or folded from one longitudinal end portion thereof to the other longitudinal end portion thereof to reduce the volume so that the main mattress portion 210 may be stored or carried.

Figure 18:
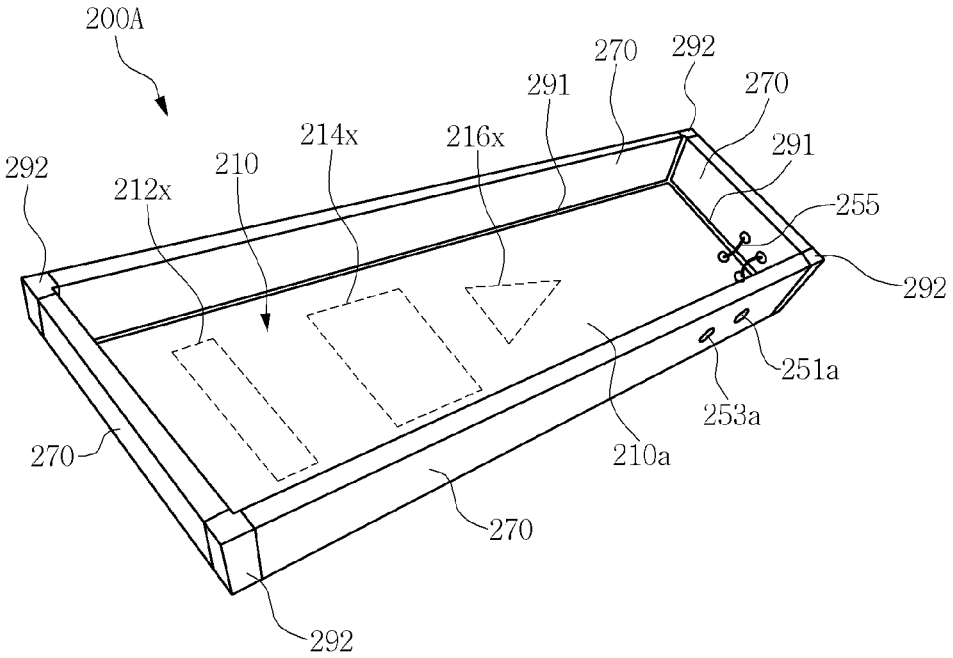
FIG. 18 is a perspective view illustrating a patient transfer air mattress according to a further another embodiment of the present disclosure.
Figure 19:
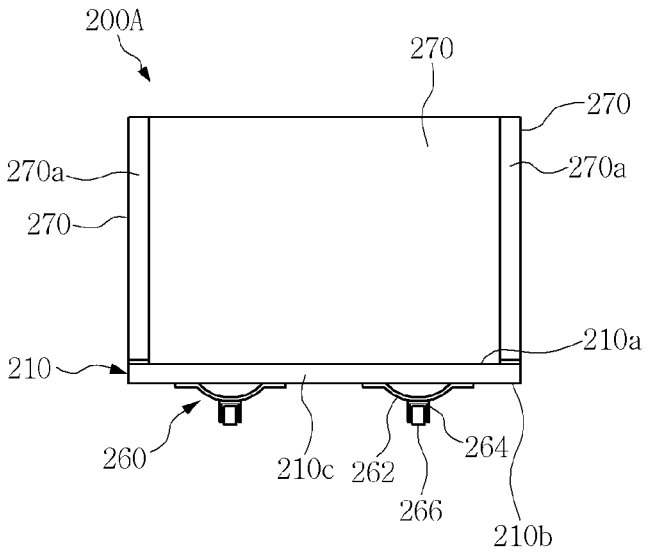
FIG. 19 is a cross-sectional view of the patient transfer air mattress illustrated in FIG. 18.
Figure 20:
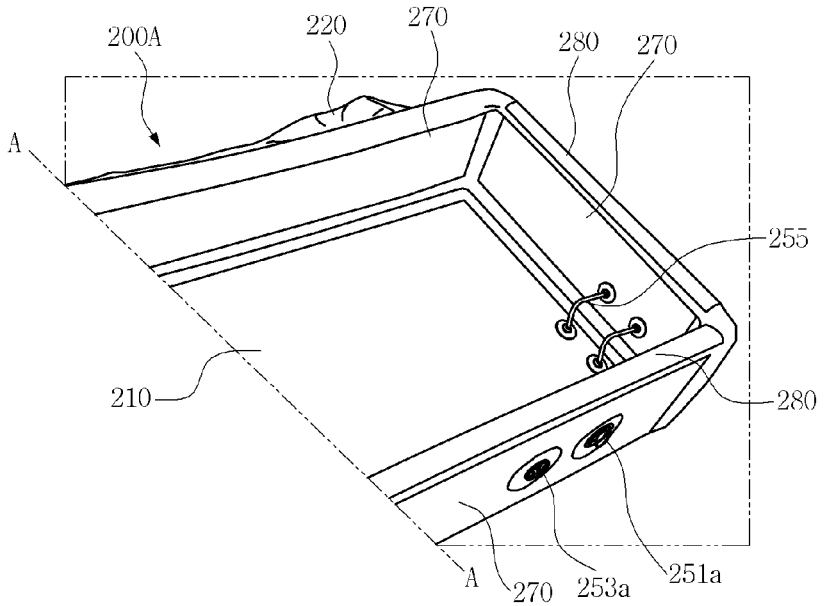
FIG. 20 is a partial perspective view of the patient transfer air mattress illustrated in FIG. 18.
Figure 21:
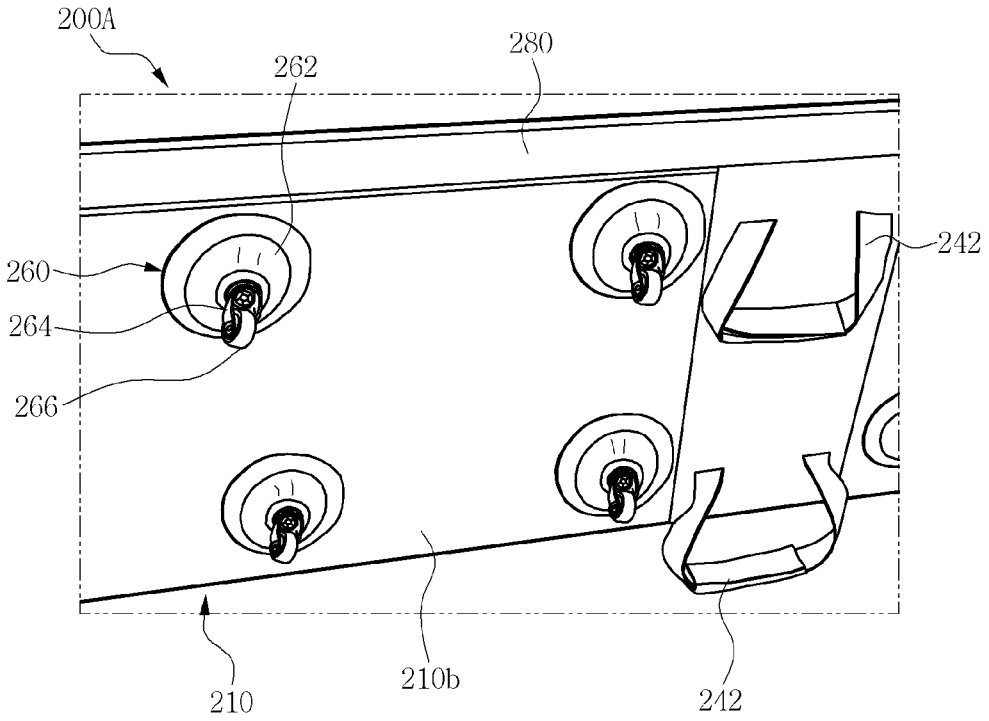
FIG. 21 is an example view illustrating embossment wheel units and handle straps usable in the patient transfer air mattress illustrated in FIG. 18.

FIG. 18 is a perspective view illustrating a patient transfer air mattress according to a further another embodiment of the present disclosure. FIG. 19 is a cross-sectional view of the patient transfer air mattress illustrated in FIG. 18. FIG. 20 is a partial perspective view of the patient transfer air mattress illustrated in FIG. 18. FIG. 21 is an example view illustrating embossment wheel units and handle straps usable in the patient transfer air mattress illustrated in FIG. 18.

Referring to FIGS. 18 to 21, the patient transfer air mattress 200A according to the present embodiment includes a main mattress portion 210, a cover 220, cushion wheel units 260, side pad portions 270, and pad-joining portions 291 and 292. The main mattress portion 210 includes a head-fixing unit, a body-fixing unit, a pelvis-fixing unit, a fastening means, handle straps 242, an air inlet, an air outlet, and a third joining means 280. A second joining means 222 may be provided on one edge of the cover 220.

The main mattress portion 210 may be made of a flexible material, and may be formed to have the shape of a thin plate with a predetermined length and a predetermined width when the inside thereof is charged with gas or air. The edge portions of the top surface 210*a* of the main mattress portion 210 may be integrally connected to the side pad portions 270 via the pad-joining portions 291 and 292.

In the main mattress portion 210 and the four side pad portions 270 coupled to the edge portions of the four sides of the main mattress portion 210, an internal space 210*c* of the main mattress portion 210 and an internal space 270*a* of each of the side pad portions 270 may be connected via at least one gas channel pipe 255 made of a flexible material in such a manner that fluid is in communication therebetween. Each of the four side pad portions 270 may be connected to the main mattress portion 210 in such a manner that fluid is in communication therebetween, but is not limited thereto. According to embodiments, one of the four side pad portions 270 may be connected to the main mattress portion 210 in such a manner that fluid is in communication therebetween, and the remaining side pad portions may be connected to each other in such a manner that fluid is in communication within the second pad-joining portions 292. In addition, at least one of the side pad portions 270 may independently include at least one of an air inlet 251*a* and an air outlet 253*a*.

The top surface 210*a* of the main mattress portion 210 may include a first portion 212*x*, a second portion 214*x*, and a third portion 216*x*. The head-fixing unit fixing the head of an immobile person, such as a patient, laid on the main mattress portion 210 is disposed on the first portion 212*x*. The body-fixing unit fixing the body of the immobile person is disposed on the second portion 214*x*. The pelvis-fixing unit fixing the pelvis of the immobile person is disposed on the third portion 216*x*.

The fastening means, the handle straps 242, the air inlet, and the air outlet are provided on the bottom surface 210*b* of the main mattress portion 210. In addition, the cushion wheel units 260 are provided on the bottom surface 210*b*.

The side pad portions 270 are disposed on edge portions of the four sides of the main mattress portion 210 to have a predetermined height (e.g. from 500 mm to 700 mm) from the top surface 210*a* of the main mattress portion 210. The side pad portions 270 may be integrally coupled to the main mattress portion 210 via the pad-joining portions 291 and 292. When gas, such as air, is injected to the main mattress portion 210, the side pad portions may be inflated together or simultaneously, thereby forming a predetermined wall shape. In addition, when the gas is discharged from the main mattress portion 210, the side pad portions may be deflated together, thereby forming a flexible shape.

The third joining means 280 may be provided on the top surfaces of three side pad portions 270 among the four side pad portions 270. The third joining means 280 may be detachably joined to the second joining means 222 provided on one side of the cover 220. The second joining means 222 and the third joining means 280 may be implemented as Velcro fasteners or the like.

The pad-joining portions 291 and 292 may include the first pad-joining portions 291 and the second pad-joining portions 292. The first pad-joining portions 291 may be disposed to fix the four side pad portions 270 to the edge portions of the four sides of the main mattress portion 210, respectively. The second pad-joining portions 292 may be disposed to form elastic corner portions between the adjacent surfaces of the four side pad portions.

As described above, the patient transfer air mattress 200A according to the present embodiment may include components substantially the same as those of the patient transfer air mattress described above with reference to FIGS. 13 to 17, except for modifications or additions of the side pad portions 270, the pad joining portions 291 and 292, and related components (e.g. 251*a*, 253*a*, and 280). Accordingly, descriptions of the repetitive components will be omitted.

Figure 22:
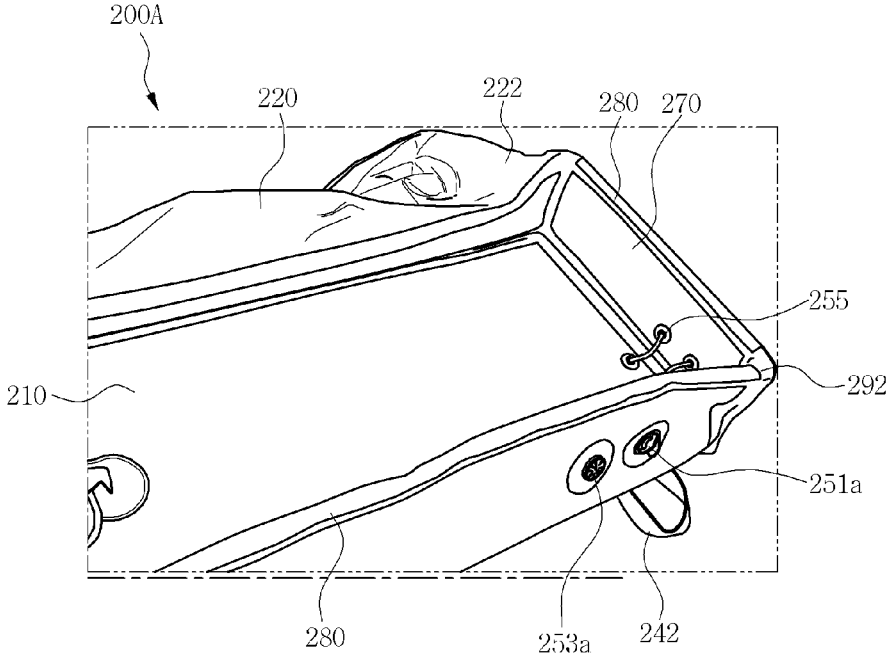
FIG. 22 is an example view illustrating the state of the air mattress in a process of removing gas from the inside of the patient transfer air mattress illustrated in FIG. 20.
Figure 23:
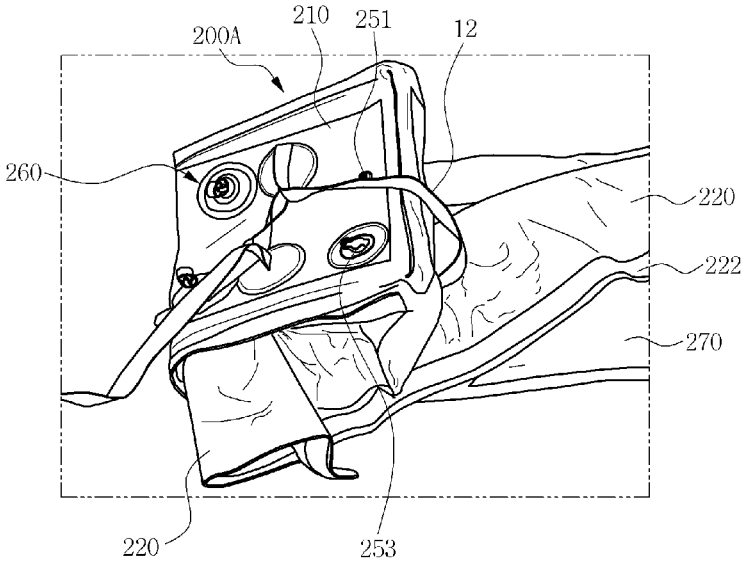
FIG. 23 is an example view illustrating the state of the air mattress, a portion of which is folded in a state in which most of the gas inside the patient transfer air mattress illustrated in FIG. 20 is removed.

FIG. 22 is an example view illustrating the state of the air mattress in a process of removing gas from the inside of the patient transfer air mattress illustrated in FIG. 20. FIG. 23 is an example view illustrating the state of the air mattress, a portion of which is folded in a state in which most of the gas inside the patient transfer air mattress illustrated in FIG. 20 is removed. In addition, FIGS. 24A to 24C are views illustrating the folded state and the size of the patient transfer air mattress illustrated in FIG. 20.

Figure 24:
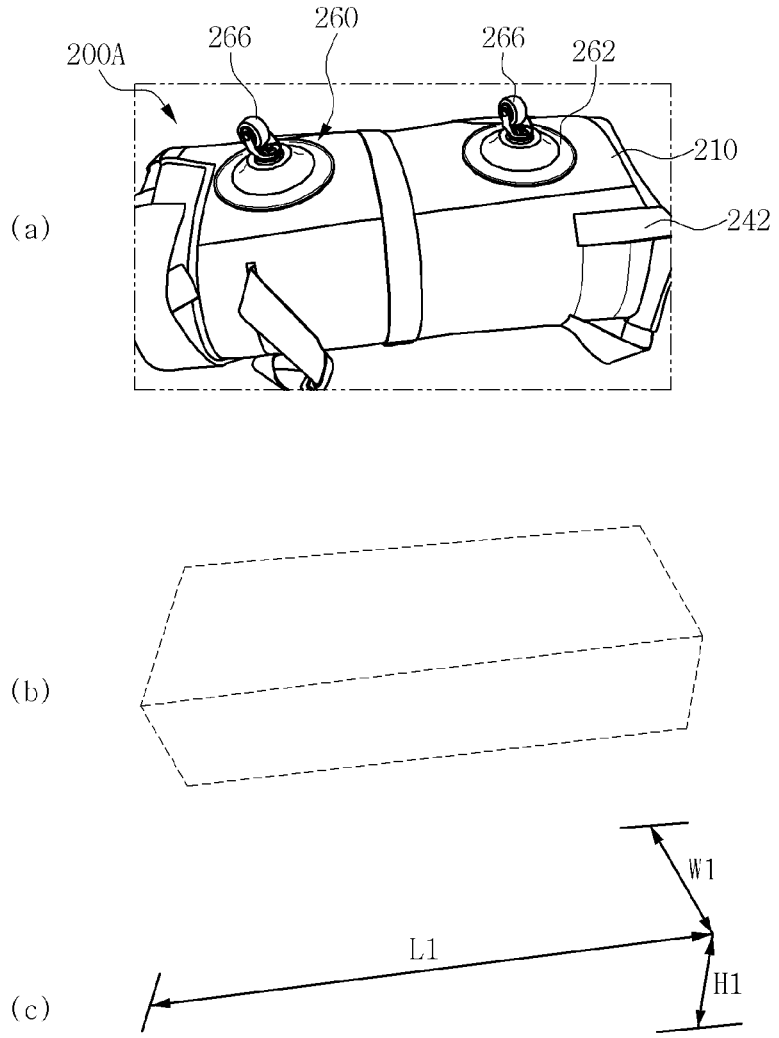
FIG. 24 is views illustrating the folded state and the size of the patient transfer air mattress illustrated in FIG. 20.

Referring to FIGS. 22 to 24, the volume of the patient transfer air mattress 200A according to the present embodiment may be reduced by removing gas, such as air or inert gas, from the internal spaces of a main mattress portion 210 and the side pad portions 270.

For example, when removing the gas from the inside of the patient transfer air mattress 200A is started, the shape of the main mattress portion 210 and the shape of the side pad portions 270 are deflated as illustrated in FIG. 22. As illustrated in FIG. 23, the flattened side pad portions 270 and the flattened cover 220, from which the gas is removed, may be stacked on the deflated main mattress portion 210, from which the gas is removed.

After the gas in the inside of the patient transfer air mattress 200A is removed, a user may fold or roll up the air mattress 200A by him/herself or using a set of equipment, thereby further reducing the volume of the patient transfer air mattress 200A, as illustrated in FIG. 23. The patient transfer air mattress 200A, the volume of which is reduced, may be packed, for example, to a volume having the shape of a rectangular cuboid, with the cushion wheel units being exposed from one surface thereof, as illustrated in FIG. 24A. The patient transfer air mattress 200A packed to have the shape of a rectangular cuboid may have a reduced volume having a length L1 of 500 mm to 700 mm, a width W1 of 200 mm to 300 mm, a thickness T1 of 150 mm to 200 mm, as illustrated in FIGS. 24B and 24C.

When the patient transfer air mattress 200A, which is automatically inflatable and packable, is used, the patient transfer air mattress 200A may be easily carried and stored. In the event of an accident, such as a fire, the immobile person, such as a patient having difficulty in movement, may be efficiently transferred by a small number of persons. In the foregoing embodiments, the side pads may correspond to the side pad portions.

FIGS. 25 to 33 are example views illustrating technical configurations usable in a patient transfer air mattress according to yet another embodiment of the present disclosure.

Figure 25:
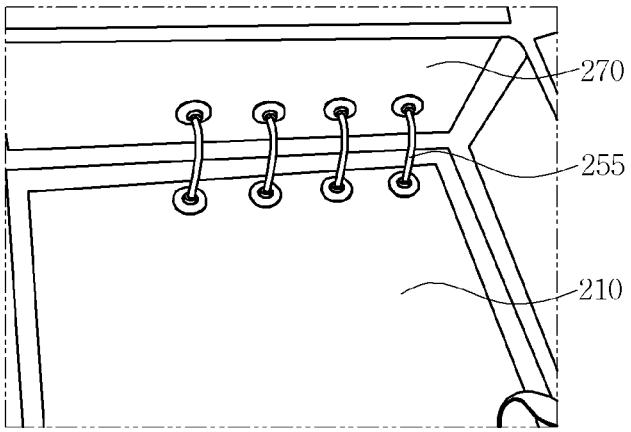
FIGS. 25 to 33 are example views illustrating technical configurations usable in a patient transfer air mattress according to yet another embodiment of the present disclosure.

First, as illustrated in FIG. 25, a bumper type air mattress according to the present embodiment may include four gas connecting pipes 255 forming a plurality of gas channels or air channels between a main mattress portion 210 and a single side pad portion 270 in such a manner that fluid is in communication between the main mattress portion 210 and the single side pad portion 270 via the four gas connecting pipes 255. When four or more gas connecting pipes 255 are used, the side pad portions 270 may be efficiently and rapidly charged with gas or air through the main mattress portion 210.

Figure 26:
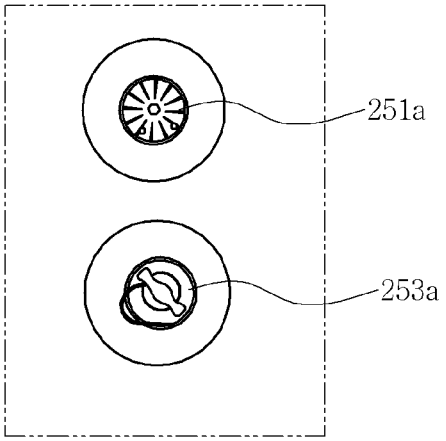

In addition, as illustrated as in FIG. 26, the main mattress portion or the side mattress portions may include an air inlet 251*a* and an air outlet 253*a*. In particular, the air inlet 251*a* according to the present embodiment serves as a pressure valve. The air inlet 251*a* serving as the pressure valve may be referred to as a pressure valve. When an excessive pressure having a predetermined or higher level is formed within the main mattress portion or the side pad portions, a predetermined amount of gas or air may be automatically discharged in order to prevent the internal pressure of the main mattress portion or the side pad portions from excessively increasing. Accordingly, when the patient on the air mattress is moved over a bottom having severe concaves and convexes, such as stairs, it is possible to prevent the internal pressure of the main mattress portion or the side pad portions from being instantaneously increased to an excessive level by external impact applied to the air mattress from an edge of a step of the stairs, thereby preventing the main mattress portion or the side pad portions from being damaged or torn.

Figure 27:
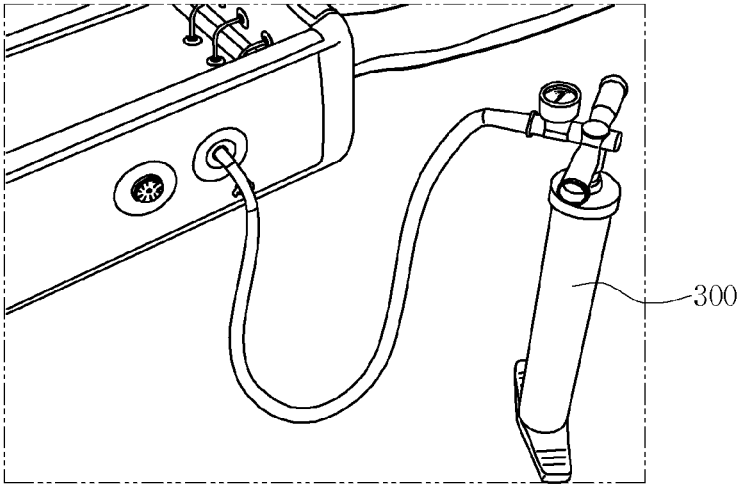
Figure 28:
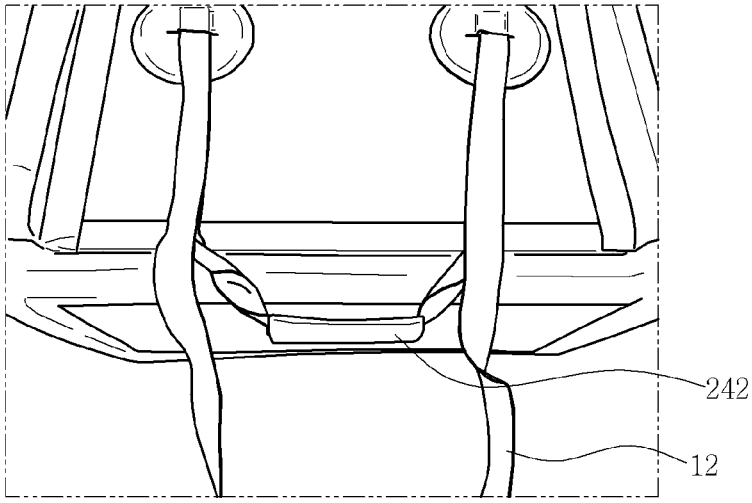
Figure 29:
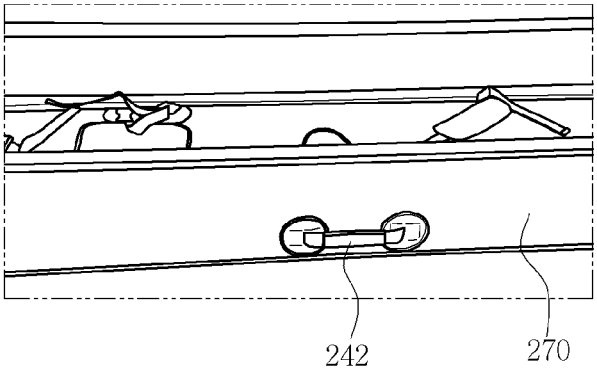
Figure 30:
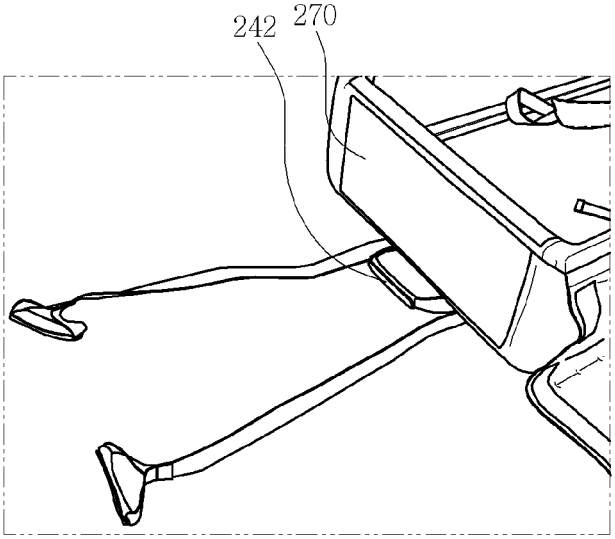

In addition, as illustrated in FIG. 27, a manual pump 300 may be connected to the air inlet. That is, the air inlet may have a structure to which the nozzle of the manual pump 300 is fixedly inserted. Accordingly, in the air mattress according to the present embodiment, the inside of the main mattress portion or the side pad portions may be manually charged with external gas or air in a specific case.

Figure 31:
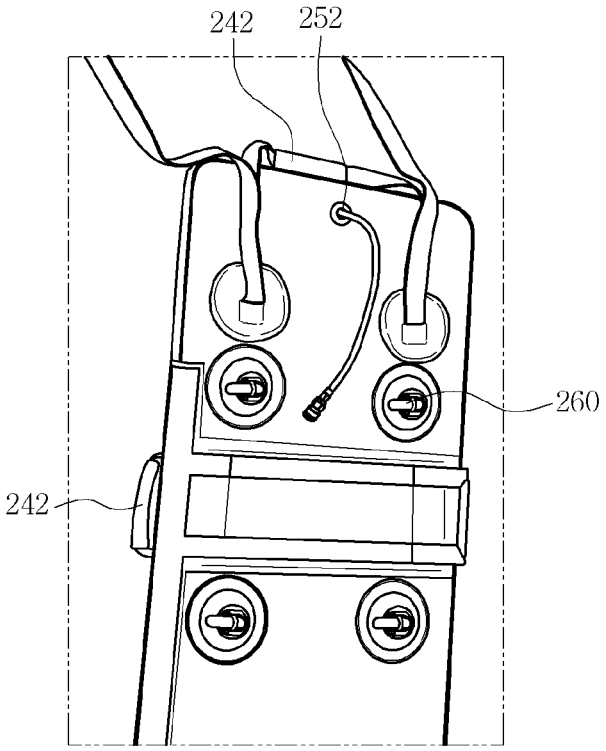

In addition, as illustrated in FIGS. 28, 29, 30, and 31, the bumper type air mattress including the side pad portions 270 may include handles 242 on front and rear surfaces and side surfaces in the longitudinal direction. When the handles 242 are provided, persons may efficiently carry the bumper type air mattress using the handles 242, rather than pulling the bumper type air mattress using traction cords 12 provided on the front and rear surfaces in the longitudinal direction of the bumper type air mattress. The configuration of the handles 242 may be substantially equally applied to a portable air mattress. For example, the handles 232 provided on the rear surface of the portable air mattress are as illustrated in FIG. 31.

Figure 32:
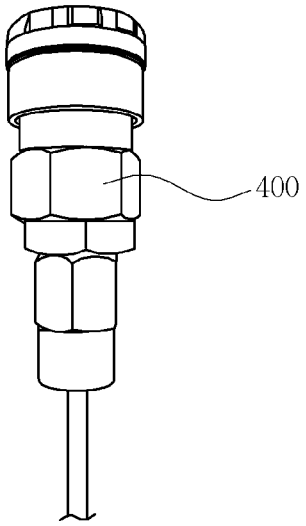

In addition, as illustrated in FIGS. 31 and 32, the position of the main air inlet or the second air inlet 252 serving as a gas supply means without serving as a pressure valve may be changed to any position. In the air mattress according to the foregoing embodiment, the second air inlet 252 is disposed in the bottom end portion of the main mattress portion in which the handles 242 and the cushion wheel units 260 are disposed, but the present disclosure is not limited thereto. The second air inlet 252 may be disposed in a portion of the main mattress portion adjacent to a foot of a person when the person is laid on the air mattress or may be disposed outside of the side pad portions.

Figure 33:
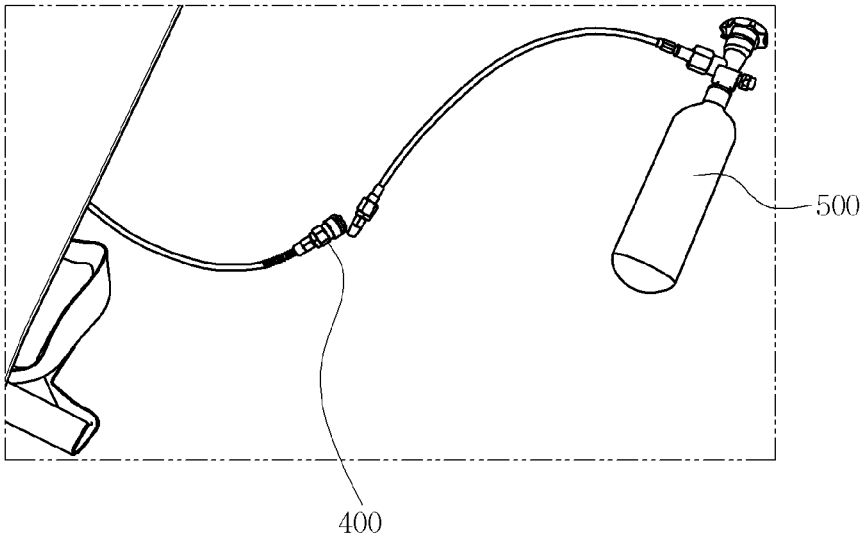

In addition, as illustrated in FIGS. 32 and 33, an external gas container 500 may be attached to and detached from the air mattress using a check valve 400 including a pipe having a predetermined length. When the check valve 400 is used, a gas tank mounted inside the air mattress may be connected to or disconnected from the external gas container 500 of high-pressure gas via the check valve 400. In a case in which the external gas container 500 is connected to the gas tank, the gas tank or an air capsule may be charged with air. In this case, it is of course possible to charge the inside of the main mattress portion or the side pad portions with air by operating the gas tank or the air capsule mounted inside the main mattress portion.

Although the present disclosure has been described above with reference to the preferred embodiments of the present disclosure, those skilled in the art will understand that the present disclosure may be modified and changed variously without departing from the spirit and scope of the present disclosure recited in the following claims. In addition, the operating sequence of the components described hereinabove is not necessarily limited to a time sequence. Even in the case that the sequence of specific components or steps in a process is changed, the process may belong to the scope of the present disclosure as long as the technical principle of the present disclosure is satisfied.

The invention claimed is:

1. An automatically inflatable patient transfer air mattress comprising:

a main mattress portion forming a plate shape having a predetermined thickness when charged and inflated with air, the main mattress portion having a first internal space;

four side pad portions coupled to four edge portions of a top surface of the main mattress portion, respectively, each of the four side pad portions having a second internal space and a plate shape having a predetermined thickness when charged and inflated with air, two neighboring side pad portions being coupled to each other;

a protective cover portion provided on one side surface of the main mattress portion or one of the four side pad portions in a longitudinal direction, and configured to cover the main mattress portion when the main mattress portion and the four side pad portions are charged and inflated with air;

a cushion wheel unit disposed on a bottom portion of the main mattress portion to absorb impact from below;

a gas channel pipe connecting the first internal space to the second internal space of the each of the four side pad portions such that air fluid is in communication between the first internal space and the second internal space, the gas channel pipe being made of a flexible material;

an air inlet formed in the main mattress portion or the four side mattress portions, and an air outlet formed in the main mattress portion or the four side mattress portions; and a first pad-joining portion disposed between and elastically coupling the main mattress portion and each of the four side pad portion; and a second pad-joining portion disposed between and elastically coupling two neighboring side pad portions.

2. The automatically inflatable patient transfer air mattress of claim 1, wherein the cushion wheel unit includes:

a cushion body fixedly attached to a bottom surface of the main mattress portion, in a shape of an embossment;

a wheel-fixing portion disposed on an outer central portion of the cushion body;

a wheel rotatably coupled to the wheel-fixing portion; and an elastic member disposed inside the cushion body to absorb shock.

3. The automatically inflatable patient transfer air mattress of claim 1, wherein the air inlet is connected to a gas tank or a gas capsule storing compressed air to supply air to the first internal space or the second internal space.

4. The automatically inflatable patient transfer air mattress of claim 3, wherein the gas tank or the gas capsule is disposed inside the main mattress portion.

5. The automatically inflatable patient transfer air mattress of claim 1, wherein the protective cover portion includes:

an air prefilter made of a nonwoven component;

a charcoal filter provided below the air prefilter and serving as a carbon filtration filter composed by containing activated carbon; and a dustproof filter layer provided below the charcoal filter to block fine dust or particles of hazardous substances.

6. The automatically inflatable patient transfer air mattress of claim 1, wherein the air inlet or the air outlet includes: a pressure valve.

7. The automatically inflatable patient transfer air mattress of claim 1, further comprising: a shock-absorbing member disposed on the bottom portion of the main mattress portion, the shock-absorbing member being configured to be charged and inflated with air.

8. An automatically inflatable patient transfer air mattress comprising:

a main mattress portion forming a plate shape having a predetermined thickness when charged and inflated with air, the main mattress portion having a first internal space;

four side pad portions coupled to four edge portions of a top surface of the main mattress portion, respectively, each of the four side pad portions having a second internal space and a plate shape having a predetermined thickness when charged and inflated with air, two neighboring side pad portions being coupled to each other;

a protective cover portion provided on one side surface of the main mattress portion or one of the four side pad portions in a longitudinal direction, and configured to cover the main mattress portion when the main mattress portion and the four side pad portions are charged and inflated with air;

a cushion wheel unit disposed on a bottom portion of the main mattress portion to absorb impact from below;

a gas channel pipe connecting the first internal space to the second internal space of the each of the four side pad portions such that air fluid is in communication between the first internal space and the second internal space, the gas channel pipe being made of a flexible material; and an air inlet formed in the main mattress portion or the four side mattress portions, and an air outlet formed in the main mattress portion or the four side mattress portions, wherein the air inlet is connected to a gas tank or a gas capsule storing compressed air to supply air to the first internal space or the second internal space, and wherein the gas tank or the gas capsule is disposed inside the main mattress portion.

* * * * *